US005185316A

United States Patent [19]

Egashira et al.

[11] Patent Number: 5,185,316

[45] Date of Patent: Feb. 9, 1993

[54] HEAT TRANSFER IMAGE-RECEIVING SHEETS

[75] Inventors: Noritaka Egashira; Yoshinori Nakamura; Ryohei Takiguchi, all of Tokyo, Japan

[73] Assignee: Dai Nippon Insatsu Kabushiki Kaisha, Japan

[21] Appl. No.: 609,640

[22] Filed: Nov. 6, 1990

[30] Foreign Application Priority Data

Nov. 7, 1989 [JP] Japan ..... 1-287963
Dec. 29, 1989 [JP] Japan ..... 1-342975

[51] Int. Cl.[5] ..... B41M 5/035; B41M 5/38

[52] U.S. Cl. ..... 503/227; 428/195; 428/423.1; 428/474.4; 428/480; 428/500; 428/522; 428/913; 428/914

[58] Field of Search ..... 8/471; 428/195, 913, 428/914, 423.1, 474.4, 480, 500, 522; 503/227

[56] References Cited

U.S. PATENT DOCUMENTS 4,555,427 11/1985 Kawasaki et al. ..... 428/195
4,615,938 10/1986 Hotta et al. ..... 428/195

*Primary Examiner*—B. Hamilton Hess
*Attorney, Agent, or Firm*—Parkhurst, Wendel & Rossi

[57] ABSTRACT

A heat transfer image-receiving sheet including a substrate sheet and a dye-receiving layer formed on at least one surface of the substrate sheet, wherein the dye-receiving layer includes at least two microscopically separated phase regions of resins differing in dyeability, and wherein the phase regions include a dispersion phase of a lipophilic resin and a dispersion medium phase of a hydrophilic resin.

5 Claims, 1 Drawing Sheet

HEAT TRANSFER IMAGE-RECEIVING SHEETS

BACKGROUND OF THE INVENTION

The present invention relates to a heat transfer image-receiving sheet improved in both printing properties (imagewise properties) and the storability of recorded images and, more particularly, to a heat transfer image-receiving sheet capable of making image representations excelling in color density, clearness and fastness properties, especially, light resistance, storability, etc.

Among various heat transfer techniques so far known in the art, there is a sublimation type of transfer system wherein a sublimable dye as a recording material is carried on a substrate sheet such as paper or a plastic film to make a heat transfer sheet, which is in turn overlaid on a heat transfer sheet dyeable with a sublimable dye, for instance, a heat transfer sheet comprising paper or a plastic film having a dye-receiving layer on its surface to make various full-color images thereon. In this system, the thermal head of a printer is used as heating means to transfer three-, four- or more-color dots by a very quick heating, thereby reconstructing a full-color image of an original manuscript by the multicolor dots.

Because the coloring material used is a dye, the thus formed image is so clear and so excellent in transparency that the resulting image representation can be improved in the reproducibility of halftone and gray scale. This makes it possible to form image representations similar to those achieved with conventional offset or gravure printing and comparable in quality to full-color photographic images.

For the effective implementation of the heat transfer technique, the construction of a image-receiving sheet is an important as the construction of a heat transfer sheet.

To put it another way, the dye-receiving layer of the image-receiving sheet is required to excel in dye receptivity and take hold of a dye in place, after it has been transferred.

Improving the fixation of the dye transferred may be achieved by forming a dye-receiving layer of a resin having an increased dyeability. A problem with such a dye having an increased dyeability, however, is that the resulting image becomes blurred in the dye-receiving layer containing it during storage or degrades in storability. The fact that such a resin is inferior in dye-fixing properties leads to another problem that the dye is likely to bleed through the dye-receiving layer, contaminating other articles in contact with its surface. Still another problem is that such a resin causes the associated heat transfer sheet to adhere to the image-receiving sheet during heat transfer, peeling off the dye layer.

These problems may be solved by forming a dye-receiving layer of a resin making the received dye difficult to migrate through the dye-receiving layer. A problem with such a resin, however, is that it is so inferior in dye-fixing properties that image of high density and clearness can not be obtained.

In order to solve the above-mentioned two major problems, the use of a mixture of a resin having an increased dyeability with a resin having a reduced dye migration may be envisaged. This, however, offers no effective solution, since that mixture is intermediate in nature between both the resins.

SUMMARY OF THE INVENTION

It is therefore an object of this invention to provide a heat transfer image-receiving sheet which can give a clear image of sufficient density when used with the heat transfer technique making use of a sublimable dye, and enables the resultant image to excel in fastness properties, especially storability, light resistance, migration resistance, and the like.

This object is achieved by the following one aspect of this invention.

According to the first aspect of this invention, there is thus provided a heat transfer image-receiving sheet including a dye-receiving layer formed on at least one surface of a substrate sheet, characterized in that the dye-receiving layer comprises at least two microscopically separated phase regions of resins differing in dyeability.

As schematically illustrated in FIG. 1, a dye-receiving layer, shown generally at 1, of a heat transfer image-receiving sheet comprises at least two microscopically separated phase regions of resins differing in dyeability, one resin region (defined by a multiplicity of closed domains) 2 having an increased dyeability and the other resin region (defined by a multiplicity of open domains) 3 having a reduced dyeability.

A dye transferred onto such a dye receiving layer develops a clear color of high density at each domain 2 having an increased dyeability. Around each domain 2 there are then domains 3 having a reduced dyeability. In consequence, the dye does not migrate from one domain 2 to another, thus giving a clear image representation of high density.

In a preferable embodiment, sensitizers, thermal release agents, antioxidants, UV absorbers, light stabilizers, and the like may be added to the resin region having an increased dyeability, whereby the color development, thermal release properties, light resistance, and the like, of the dye transferred are much more improved. In this case, these additives continue to produce their own effects more efficiently over a longer period of time, since they are confined in the dyed region at an increased concentration, rather than being distributed throughout the dye-receiving layer.

ILLUSTRATIVE EXPLANATION OF THE INVENTION

Figure 1:
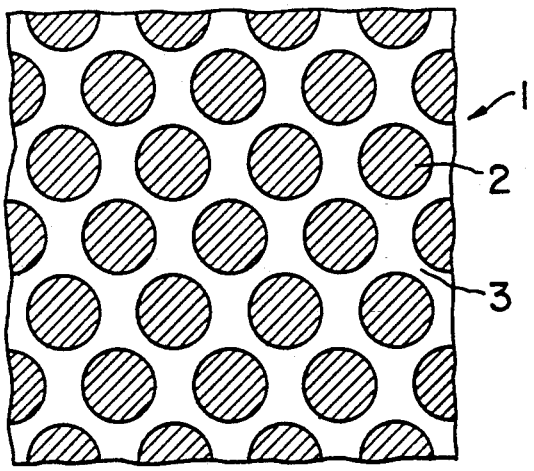
FIG. 1 is a schematic view showing the microscopically separated structure of one typical dye-receiving layer of the heat transfer image-receiving sheet according to this invention.

The present invention will now be explained in greater detail with reference to some preferred embodiments.

The heat transfer image-receiving sheet according to this invention comprises a substrate sheet and a dye-receiving layer formed on at least one surface thereof.

No limitation is placed on substrate sheets used in this invention. For instance, use may be made of various types of papers such as synthetic paper (based on polyolefin, polystyrene, etc.), fine paper, art paper, coated paper, cast coated paper, wall paper, backing paper, synthetic resin or emulsion impregnated paper, synthetic rubber latex impregnated paper, synthetic resin intercalated paper, paper board and cellulose fiber paper; and various kinds of plastic films or sheets based on, e.g. polyolefin, polyvinyl chloride, polyethylene terephthalate, polystyrene, polymethacrylate and polycarbonate. Use may also be made of white, opaque films or foamed sheets obtained from such synthetic resins to which white pigments and fillers are added.

The aforesaid substrate sheets may be laminated together in any desired combination. Examples of typical laminates are combined cellulose fiber paper/synthetic paper and combined cellulose fiber paper/plastic films or sheets. The substrate sheet or sheets may have any desired thickness, for instance, a thickness of generally about 10 to 300 μm.

If the substrate film is poor in its adhesion to the dye-receiving layer to be formed on its surface, then it may preferably be primer- or corona discharge-treated on its surface.

The dye-receiving layer according to this invention is formed on the surface of the substrate sheet with a view to receiving a sublimable dye coming from the associated heat transfer sheet and maintain the resultant image, and is chiefly characterized by being of a microscopically separated phase structure.

In the present disclosure, it is understood that the term "microscopically separated phase structure" refers to a structure in which a multiplicity of closed domains are separated from a multiplicity of open domains, as sketched in FIG. 1.

Typically, the microscopically separated phase structure may be achieved by the following manners.

(1) A dispersion or emulsion of a dye having a relatively reduced dyeability (i.e. a resin excelling in dye retaining properties, release properties, and the like) is first divided into two portions. A sensitizer well compatible with said resin is then added to and absorbed in one portion. Finally, said one portion is mixed with the other portion in conventional manners to form a dye-receiving layer. It is to be noted that additives such as thermal release agents, antioxidants, UV absorbers and light stabilizers may be added to the sensitizer containing resin particles. It is also to be noted that such additives may be added to the resin prior to granulation.

(2) Two resins, which are incompatible with each other and one of which is superior in dyeability to the other, are mixed together to prepare a coating liquid, which may then be formed into a dye-receiving layer in conventional manners. It is to be noted that both the resins may be dissolved or dispersed in a solvent, or either one of them may be dissolved in a solvent. In any case, as the solvent of the coating liquid evaporates off after coating, the two resins undergo microscopic phase separation.

The degree of incompatibility of the two resins with each other may easily be determined by how much cloudy resin mixture or liquid is formed by hot-mixing or hot-dissolution of them in an organic solvent, followed by cooling.

One of at least two types of resins, i.e. resins having an increased dyeability may preferably be selected from highly lipophilic resins such as polyester resins, vinylic resins based on polyvinyl chloride, vinyl chloride/vinyl acetate copolymers and vinylidene chloride, and polyurethane resins. As the other resins having a reduced dyeability, use may be made of, by way of example only, highly hydrophilic or water-soluble resins such as polyvinyl alcohol, polyacrylic acid resins, polyacrylamide, polyethyleneimine, polyethylene oxide, polyvinyl ether, styrene/allyl alcohol copolymer resins, polyvinyl pyrrolidone, maleic acid resins, polyvinylamine, cellulose, cellulose derivatives, polyethylene glycol, polyvinylmethoxyacetal and gelatine. If required, techniques for forming emulsions or suspensions may be employed. It is here to be understood that images of much more increased clearness, density, release properties and light resistance may be obtained by the incorporation of additives such as sensitizers, thermal release agents, antioxidants, UV absorbers and light stabilizers in the resin having an increased dyeability.

When one type of resin, e.g. the resin having an increased dyeability is used in too small an amount, the ability of the resultant dye-receiving sheet to receive a dye becomes insufficient. In too large an amount, on the other hand, the resistance of the resultant dye-receiving layer to heat, dye migration, contamination and so on again becomes insufficient. Studies of the inventors teach that the mixing ratio of the two types of resins lies in the range of preferably 90-10/10-90, more preferably 90-40/10-60 by weight.

Especially when a combination of a water-dispersible resin with a water-soluble resin is applied, their mixing ratio (water-dispersible resin/water-soluble resin) lies in the range of preferably 0.5–5.0, more preferably 0.8–2.0 by weight.

It is here to be understood that a system composed mainly of such two types of resins as mentioned above may be used in combination with other resins.

The sensitizer used in this invention is a low-molecular-weight material having a melting point of 50°–150° C. A sensitizer with a melting point less than 50° C. is unpreferred, since it is likely to migrate through the dye-receiving layer. A sensitizer with a melting point higher than 150° C., on the other hand, is again unpreferred, since its sensitization drops sharply.

Also, the sensitizer used in this invention should preferably have a molecular weight in the range of 100–1,500. A sensitizer with a molecular weight less than 100 makes it difficult to maintain its melting point at 50° C. or higher and is thus unpreferred. A sensitizer with a molecular weight higher than 1,500, on the other hand, is again unpreferred because it does not sharply melt at the time of heat transfer, failing to produce its own effect sufficiently.

Any known low-molecular-weight material may be used as the sensitizer, if it has a melting point of 50°–150° C. Illustrative examples of the sensitizers suitable for this invention are:

various thermoplastic resin oligomers such as polyurethane, polystyrene, polyester, polyacrylic, polyethylene, polyvinyl chloride, polyvinyl acetate, ethylene/vinyl acetate copolymer, ethylene/acrylic copolymer, polyoxyethylene, polyoxypropylene and polyoxyethylene-propylene oligomers;

fatty acids such as myristic, palmitic, margaric, stearic, arachic and montanic acids;

fatty acid amides such as caproic, caprylic, lauric, stearic, oleic and eicosanic acid amides;

fatty acid esters such as methyl behenate, methyl lignocerate, methyl montanate, pentadecyl palmitate, hexacosyl stearate and carbamic acid [1,4-phenylenebis(methylene)]bisdimethyl ester;

aromatic compounds such as 1,4-dicyclohexylbenzene, benzoic acid, aminobenzophenone, dimethyl terephthalate, fluoranthene, phenols, naphthalenes and phenoxies; and various waxes.

The sensitizer should preferably be used in the range of 1–100 parts by weight, particularly 20–50 parts by weight per 100 parts by weight of the dye-receiving layer forming binder. At below 1 part by weight, the sensitizer is unlikely to produce any satisfactory sensitization whereas, at higher than 100 parts by weight, there is a drop of the heat resistance of the resulting dye-receiving layer.

As the release agent preferably used in this invention, mention is made of silicone oil, phosphate type surfactants, fluorine type surfactants and so on. Preference, however, is given to silicone oil which may be modified by epoxy, alkyl, amino, carboxyl, alcohol, fluorine, alkylaralkyl polyether, epoxy/polyether, polyether and so on. In addition, various releasing resins modified with silicone or fluorine may be used.

Preferably, the amount of these release agents added lies in the range of 0.5–30 parts by weight per 100 parts by weight of the dye-receiving layer forming resin. When they are added in an amount departing from such a range, some problems may arise such as the fusion of the dye layers of heat transfer sheets to dye-receiving layers and a drop of printing sensitivity.

Antioxidants so far known in the art may all be used as the antioxidants in this invention. However, their preferable examples are:

phenolic antioxidants, for instance,
2,6-di-tert-butylphenol,
2,4-di-tert-butylphenol,
2-tert-butylphenol,
2-tert-butyl-4,6-methylphenol,
2,6-di-tert-butyl-4-methylphenol,
2,6-di-tert-butyl-4-ethylphenol,
2,5-di-tert-butylhydroquinone,
styrene-modified phenol,
2,2'-methylene-bis-(4-methyl-6-tert-butylphenol),
2,2'-methylene-bis-(4-ethyl-6-tert-butylphenol),
4,4'-butylidene-bis-(4-methyl-6-tert-butylphenol),
1,6-hexanediol-bis -]3-(3,5-di-tert-butyl(4-hydroxyphenol)]-propionate,
tri-ethylene glycol-bis-[3-(3-tert-butyl-5-methyl-4-hydroxyphenyl]-propionate,
4,4'-thio-bis-(3-methyl-6-tert-butylphenol),
2,2-thio-diethylene-bis[3-(3,5-di-tert-butyl-4-phenyl)-propionate,
tris(3,5-di-tert-butyl-4-hydroxybenzyl)isocyanate, and
tetrakis-[methylene-3-(3',5'-di-tert-butyl-4'-hydroxyphenol)propionate]-methane; aromatic amines, for instance,
4,4'-dioctyl-diphenylamine; sulfides, for instance,
ditridecyl-3,3'-thiodipropionate,
dimyristyl-3,3'-thiodipropionate,
distearyl-3,3'-thiodipropionate, and
pentaerythritol-tetrakis($\beta$-lauryl-thiopropionate); and phosphates, for instance,
tris(isodecyl)phosphate,
tris(tridecyl)phosphate,
phenyldiisooctyl phosphate,
diphenyldiisooctyl phosphate,
1,1-bisphenyl-4,4'-diyl-bis-tetrakis-[2,4-bis(1,1-dimethylethyl)phenyl]phosphoric acid,
triphenyl phosphate,
tris(2,4-di-tert-butylphenyl)phosphate,
distearyl pentaerythritol diphosphate,
3,5-di-tert-butyl-hydroxybenzyl phosphate-di-ethyl ester, and
sodium bis(4-tert-butylphenol)phosphate.

UV absorbers so far known in the art may all be used as the UV absorbers in this invention. However, their preferable examples are:

salicylates, for instance,
phenyl salicylate,
4-tert-butylphenyl salicylate,
2,4-di-tert-butylphenyl-3,5'-di-tert-4'-hydroxylbenzoate, and
4-tert-octylphenyl salicylate; benzophenones, for instance,
2,4-dihydroxybenzophenone,
2-hydroxy-4-methoxy-benzophenone,
2-hydroxy-4-methoxybenzophenone-5-sulfonic acid,
2-hydroxy-4-n-octoxybenzophenone,
bis(5-benzoyl-4-hydroxy-2-methoxyphenyl)methane, and
2-hydroxy-4-methoxy-2'-carboxybenzophenone; and benzotriazoles, for instance,
2-(2'-hydroxy-5'-methylphenyl)benzotriazole,
2-[2'-hydroxy-3',5'-bis($\alpha$,$\alpha$-dimethylbenzyl)phenyl]benzotriazole,
2-(2'-hydroxy-3',5'-di-tert-butylphenyl0benzotriazole,
2-(2'-hydroxy-3'-tert-butyl-5'-methylphenyl)-5-chlorobenzotriazole,
2-(2'-hydroxy-3',5'-di-tert-butylphenyl)-5-chlorobenzotriazole,
2-(2'-hydroxy-3',5'-di-t-amylbenzotriazole, and
2-(2'-hydroxy 5'-tert-octylphenyl)benzotriazole.

Light stabilizers so far known in the art may all be used as the light stabilizers in this invention. However, their preferable examples are:

hindered amines, for instance, phenyl-4-piperidinyl carbonate, bis[2,2,6,6-tetramethyl-4-piperydinyl sebacate, bis-(1,2,2,6,6-pentamethyl-4-piperydinyl)-2-(3,5-di-tert-butyl-4-hydroxybenzyl)-2-n-butyl malonate, and 1,1'-(1,2-ethanediyl)bis(3,3,5,5-tetra-methyl piperadinate;

nickel compounds, for instance, [2,2'-thio-bis(4-tert-octylphenolate)]-2-ethylhydroxyamine nickel (II), [2,2'-thiobis(4-octylphenolate)$_n$-butylamine nickel, nickel bis(octylphenyl)sulfide, and 2,2'-thiobis(4-tert-octylphenolate)triethanolamine nickel (II), and cyanoacrylates, for instance, oxalic acid anilide.

Although the amounts of the antioxidants, UV absorbers or light stabilizers to be used are not particularly critical, they may preferably be used in an amount of 0.05–100 parts by weight, particularly 1–20 parts by weight per 100 parts by weight of the dye-receiving layer forming resin. In too small amounts their effects to be desired are unachievable, whereas in too large amounts they are not only uneconomical but also blur the resulting images or block the image-receiving sheets.

The image-receiving sheet according to this invention may be obtained by coating at least one surface of the substrate sheet with a solution or dispersion of the required resin and additives in a suitable organic solvent by suitable means such as gravure or screen printing or reverse roll coating with a gravure and drying the coating to form a dye-receiving sheet on that surface.

When forming the dye-receiving layer, pigments or fillers such as titanium oxide, zinc oxide, kaolin, clay, calcium carbonate and finely divided silica may be added thereto with a view to improving its whiteness, thereby making further improvements in the clearness of the transferred image.

The thus formed dye-receiving layer may have any desired thickness, but is generally 1 to 50 $\mu$m in thickness. Such a dye-receiving layer should preferably be in a continuous film form, but may be formed into a discontinuous film with the use of a resin emulsion or dispersion.

By appropriately selecting substrate sheets, the image-receiving sheets of this invention may find use in various fields including heat transfer-recordable image-receiving sheets, whether size A or size B, or cards and sheets for forming a transmission type manuscripts.

In the case of the image-receiving sheet of this invention, a cushioning layer may be additionally interposed between the substrate sheet and the dye-receiving layer, thereby making it possible to reduce noise at the time of printing and transfer and record on the dye-receiving layer an image corresponding to imagewise information with good reproducibility.

The heat transfer sheet used for heat transfer to be carried out with the heat transfer image-receiving sheet of this invention includes paper or a polyester film on which a dye layer containing a sublimable dye is provided. For this invention, conventional known heat transfer sheets may all be used as such.

As heat energy applying means at the time of heat transfer, conventional applicator means hitherto known in the art may all be used. For instance, the desired object is successfully achievable by the application of a heat energy of about 5 to 100 $mJ/mm^2$ for a controlled recording time with such recording hardware as a thermal printer (e.g., Video Printer VY-100 made by Hitachi Co., Ltd., Japan).

According to this invention as described above, the dye-receiving layer 1 of a heat transfer image-receiving sheet comprises at least two microscopically separated phase regions of resins differing in dyeability, one resin region 2 having an increased dyeability and the other resin region 3 having a reduced dyeability.

A dye transferred onto such a dye receiving layer develops a clear color of high density at each domain 2 having an increased dyeability. Around each domain 2 there are then domains 3 having a reduced dyeability. In consequence, the dye does not migrate from one domain 2 to another, thus giving a clear image representation of high density.

In a preferable embodiment, sensitizers, thermal release agents, antioxidants, UV absorbers, light stabilizers, and the like may be added to the resin region having an increased dyeability, whereby the color development, thermal release properties, light resistance, and the like of the dye transferred are much more improved. In this case, these additives continue to produce their own effects more efficiently over a longer period of time, since they are present in the dyed region at an increased concentration, rather than being distributed throughout the dye-receiving layer.

Another aspect of this invention designed to improve both the quality and storability of an image representation will now be described.

More specifically, the second aspect of this invention relates to a heat transfer image-receiving sheet including a dye-receiving layer formed on at least one surface of a substrate sheet, characterized in that said dye-receiving layer comprises a curable resin and a sensitizer.

When the dye-receiving layer is formed of the curing resin and sensitizer, the sensitizer is distributed to microscopically separated phases after the curing resin has been cured. A dye coming from a heat transfer sheet is then picked up by the sensitizer in the microscopically separated phases.

Due to having a much more improved dyeability, this sensitizer enables the dye to develop a clear color of high density by transfer. Since the dyed sensitizer is surrounded with the cured resin, it is most unlikely that the dye may migrate from one sensitizer domain to another; this results in an improvement in the storability of the resulting image.

The dye-receiving layer according to the second aspect of this invention is most not likely to soften or melt by the heat generated from a thermal head during heat transfer. For that reason, no problems arise in connection with the thermal fusion of heat transfer sheets to image-receiving sheets.

In a preferable embodiment, sensitizers, thermal release agents, antioxidants, UV absorbers, light stabilizers, and the like may be added to the dye-receiving layer, whereby its thermal release properties, light resistance, and the like are much more improved. In this case, these additives continue to produce their own effects more efficiently over a longer period of time, since they are locally fixed at high concentrations in the sensitizer domains or dyed domains, rather than being distributed throughout the dye-receiving layer.

The second aspect of this invention will now be explained in greater detail with reference to some preferable embodiments.

The heat transfer image-receiving sheet according to this aspect comprises a substrate sheet and a dye-receiving layer formed on at least one surface thereof Substrate sheets used according to the second aspect are similar to those mentioned in connection with the first aspect.

The dye-receiving layer is formed on the surface of the substrate sheet to receive a dye coming from the associated heat transfer sheet and maintain the resulting image.

The curable resin for forming the dye-receiving layer has in its molecule an unsaturated double bond or reactive group such as a hydroxyl, carboxyl, amino, epoxy, isocyanate or methylol group. Usable to this end, for instance, are drying oil, synthetic drying oil, modified cellulose, epoxy resin, amino resin, polyurethane resin, alkyd resin, phenolic resin, acrylic resin, polyester resin, UV curing resin and electron radiation curing resin. Other modified thermoplastic resins may be used as well.

These curable resins may be used in combination with suitable curing agents (or crosslinkers or catalysts). Typical of the crosslinkers are polyamide, polyol, polyphenol, polyisocyanate and polyaldehyde, by way of example only.

A particularly preferred curing agent is a polyisocyanate which is of a buret or TPM adduct structure rather than an isocyanurate structure. The amount of the curing agent is in the range of 2–20 parts by weight, preferably 2–10 parts by weight per 100 parts by weight of the curing resin.

According to the 2nd aspect of this invention, use may be made of any known curable resins so far known to form conventional dye-receiving layers. For instance, use may be made of thermoplastic resins such as polyolefinic resins, e.g., polypropylene; halogenated polymers, e.g., polyvinyl chloride and polyvinylidene chloride; vinylic polymers, e.g., polyvinyl acetate, vinyl chloride/vinyl acetate copolymers, ethylene/vinyl acetate copolymers and polyacrylates; polyester type resins, e.g., polyethylene terephthalate and polybutylene terephthalate; acetal resins, e.g., polyvinyl acetacetal and polyvinyl butyral; polystyrene type resins; polyamide type resins; polyurethane resins; copolymeric resins, e.g., copolymers of olefins such as ethylene and propylene with other vinyl monomers; ionomers: cellulosic resins, e.g., cellulose diacetate and cellulose triacetate; and polycarbonates. These resins may be used in combination of two or more, as long as the object of the second aspect of this invention is attainable.

The sensitizer used according to the second aspect of this invention is a low-molecular-weight material having a melting point of 50°-150° C. A sensitizer with a melting point less than 50° C. is unpreferred, since it is likely to migrate through the dye-receiving layer. A sensitizer with a melting point higher than 150° C., on the other hand, is again unpreferred, since its sensitization drops sharply.

Also, the sensitizer used in this aspect should preferably have a molecular weight in the range of 100-1,500. A sensitizer with a molecular weight less than 100 makes it difficult to maintain its melting point at 50° C. or higher and is thus unpreferred. A sensitizer with a molecular weight higher than 1,500, on the other hand, is again unpreferred because it does not sharply melt at the time of heat transfer, failing to produce its own effect sufficiently.

Any known low-molecular-weight material may be used as the sensitizer, if it has a melting point of 50°-150° C. However, illustrative examples of the sensitizers suitable for the second aspect of this invention are:

various thermoplastic resin oligomers such as polyurethane, polystyrene, polyester, polyacrylic, polyethylene, polyvinyl chloride, polyvinyl acetate, ethylene/vinyl acetate copolymer, ethylene/acrylic copolymer, polyoxyethylene, polyoxypropylene and polyoxyethylene-propylene oligomers;

fatty acids such as myristic, palmitic, margaric, stearic, arachic and montanic acids;

fatty acid amides such as caproic, caprylic, lauric, stearic, oleic and eicosanic acid amides;

fatty acid esters such as methyl behenate, methyl lignocerate, methyl montanate, pentadecyl palmitate, hexacosyl stearate and carbamic acid [1,4-phenylenebis(methylene)]bisdimethyl ester;

aromatic compounds such as 1,4-dicyclohexylbenzene, benzoic acid, aminobenzophenone, dimethyl terephthalate, fluoranthene, phenols, naphthalenes and phenoxides; and various waxes.

Among the sensitizers as enumerated above, particularly preferred ones have a heat of fusion ($\Delta H$) lying in the range of 10-300 mJ/mg. A sensitizer with a $\Delta H$ less than 10 mJ/mg offers a problem in connection with heat stability, or is insufficient in view of the storability of the resultant image, as can be seen from the results of accelerated heat testing indicating a blur on dots. A sensitizer with a $\Delta H$ higher than 300 mJ/mg, on the other hand, is less effective for a sensitivity increase and is thus unpreferred.

Taken altogether, illustrative examples of the sensitizers preferably used according to the second aspect of this invention are fatty acid amides, aromatic carboxylic acid amides, glycerin fatty acid esters, monoesters, polyoxyethylene alkyl esters and ethers.

The sensitizer should preferably be used in the range of 1-100 parts by weight, particularly 10-40 parts by weight, more particularly 20-30 parts by weight per 100 parts by weight of the dye-receiving layer forming curing resin. At below 1 part by weight, the sensitizer is unlikely to produce any satisfactory sensitization whereas, at higher than 100 parts by weight, there is a drop of the heat resistance of the resulting dye-receiving layer.

The heat transfer image-receiving sheet according to the second aspect of this invention may be obtained by coating at least one surface of the substrate sheet with a solution or dispersion of the curing resin and sensitizer dissolved or dispersed together with the required additives such as crosslinkers, curing agents, catalysts, thermal release agents, UV absorbers, antioxidants and light stabilizers in a suitable organic solvent or water by suitable means such as gravure printing, screen printing or reverse roller coating with a gravure and, then, drying and curing the coating to form a dye-receiving layer on that surface.

When forming the dye-receiving layer, pigments or fillers such as titanium oxide, zinc oxide, kaolin, clay, calcium carbonate and finely divided silica may be added thereto with a view to improving its whiteness, thereby making further improvements in the clearness of the transferred image.

The thus formed dye-receiving layer may have any desired thickness, but is generally 1 to 50 $\mu$m in thickness. Such a dye-receiving layer should preferably be in a continuous film form, but may be formed into a discontinuous film with the use of a resin emulsion or dispersion.

By appropriate selection of substrates, the image-receiving sheets of this invention may find use in various fields including heat transfer-recordable image-receiving sheets or cards and sheets for forming transmission type manuscripts.

In the case of the image-receiving sheet of this invention, a cushioning layer may be additionally interposed between the substrate sheet and the dye-receiving layer, thereby making it possible to reduce noise at the time of printing and transfer and record on the dye-receiving layer an image corresponding to imagewise information with good reproducibility.

The heat transfer sheet used for heat transfer to be carried out with the heat transfer image-receiving sheet of this invention includes paper or a polyester film on which a dye layer containing a sublimable dye is provided. For this invention, conventional known heat transfer sheets may all be used as such.

As heat energy applying means at the time of heat transfer, conventional applicator means hitherto known in the art may all be used. For instance, the desired object is successfully achievable by the application of a heat energy of about 5 to 100 mJ/mm$^2$ for a controlled recording time with such recording hardware as a thermal printer (e.g., Video Printer VY-100 made by Hitachi Co., Ltd.).

When the dye-receiving layer is formed of the curing resin and sensitizer according to the second aspect of this invention, the sensitizer is distributed to microscopically separated domains after the curing resin has been cured. A dye coming from the associated heat transfer sheet is then picked up in the microscopically separated domains.

Due to having a much more improved dyeability, this sensitizer enables the dye to develop a clear color of high density by transfer. Since the dyed sensitizer is surrounded with the cured resin domains, it is most unlikely that the dye may migrate from one sensitizer domain to another; this results in an improvement in the storability of the resulting image.

The dye-receiving layer according to the second aspect of this invention is most not likely to soften or melt by the heat generated from a thermal head during heat transfer. For that reason, no problem arise in connection with the thermal fusion of heat transfer sheets to image-receiving sheets.

In a preferable embodiment, sensitizers, thermal release agents, antioxidants, UV absorbers, light stabilizers, and the like may be added to the dye-receiving layer, whereby its thermal release properties, light resistance, and the like are much more improved. In this case, these additives continue to produce their own effects more efficiently over a longer period of time, since they are locally fixed at high concentrations in the sensitizer domains or dyed domains, rather than being distributed throughout the dye-receiving layer.

The present invention will now be explained more illustratively but not exclusively with reference to a number of examples and comparative examples wherein, unless otherwise stated, the "parts" and "%" are given by weight.

EXAMPLE A1

With a wire bar coater, synthetic paper (of 110 μm in thickness and made by Oji Yuka K.K., Japan) as a substrate sheet was coated on one surface with a coating liquid composed of the following components to a dry coverage of 5.0 g/m$^2$. Subsequent drying gave a heat transfer image-receiving sheet according to this invention.

| Composition of coating liquid | |
|---|---|
| Water-dispersed polyester resin (having a solid content of 15% and available in the name of Vynal) | 40 parts |
| Polyvinyl alcohol (in the form of a 10% aqueous solution) | 55 |
| Sensitizer (polystyrene oligomer with a melting point of 60° C. and a molecular weight of 860) | 10 |
| Sulfide type antioxidant (Sumirizer TPL-R made by Sumitomo Chemical Co., Ltd.) | 0.5 |
| Benzotriazole type UV absorber (Chinubin-1130 made by Ciba Geigy AG) | 0.5 |

EXAMPLES A2–A18

The procedure of Ex. Al was followed with the exception that the following were used as coating liquids, thereby obtaining heat transfer image-receiving sheets according to this invention.

EXAMPLE A2

| Composition of coating liquid | |
|---|---|
| Water-dispersed polyester resin (having a solid content of 15% and available in the name of Vynal) | 40 parts |
| Polyvinyl alcohol (in the form of a 10% aqueous solution) | 55 |
| Sensitizer (stearic acid bisamide) | 5 |
| Sulfide type antioxidant (Sumirizer TPL-R made by Sumitomo Chemical Co., Ltd.) | 0.5 |
| Hindered amine type light stabilizer (Sandbar 3052 made by Sand Co., Ltd.) | 0.5 |

EXAMPLE A3

| Composition of coating liquid | |
|---|---|
| Water-dispersed polyester resin (having a solid content of 15% and available in the name of Vynal) | 40 parts |
| Gelatine | 50 |
| Sensitizer (aminobenzophenone) | 7 |
| Phenolic antioxidant (Irganox 245 made by Ciba Geigy AG) | 0.5 |
| Benzophenone type UV absorber (Ubinal X-19 made by BASF Co., Ltd.) | 0.3 |

EXAMPLE A4

| Composition of coating liquid | |
|---|---|
| Urethane emulsion (having a solid content of 40% and available in the name of Alone VE-1200) | 10 parts |
| Polyvinyl alcohol (in the form of a 10% aqueous solution | 50 |
| Sensitizer (polystyrene oligomer with a melting point of 60° C. and a molecular weight of 860) | 8 |
| Phenolic antioxidant (Irganox 245 made by Ciba Geigy AG) | 0.5 |
| Hindered amine type light stabilizer (Sumisorb-500 made by Sumitomo Chemical Co., Ltd.) | 0.5 |

EXAMPLE A5

| Composition of coating liquid | |
|---|---|
| Urethane emulsion (having a solid content of 40% and available in the name of Alone VE-1200) | 10 parts |
| Polyvinyl alcohol (in the form of a 10% aqueous solution) | 50 |
| Sensitizer (stearic acid bisamide) | 5 |
| Sulfide type antioxidant (Sumirizer TPL-R made by Sumitomo Chemical Co., Ltd.) | 0.5 |
| Benzophenone type UV absorber (Chinubin-1130 made by Ciba Geigy AG) | 0.5 |

EXAMPLE A6

| Composition of coating liquid | |
|---|---|
| Urethane emulsion (having a solid content of 40% and available in the name of Alone VE-1200) | 10 parts |
| Gelatine | 50 |
| Sensitizer (aminobenzophenone) | 7 |
| Sulfide type antioxidant (Sumirizer TPL-R made by Sumitomo Chemical Co., Ltd.) | 0.5 |
| Benzophenone type UV absorber (Ubinal X-19 made by BASF Co., Ltd.) | 0.3 |

EXAMPLE A7

| Composition of coating liquid | |
|---|---|
| Water-dispersed polyester resin (having a solid content of 15% and available in the name of Vynal) | 40 parts |
| Polyvinyl alcohol (in the form of a 10% aqueous solution) | 55 |
| Sulfide type antioxidant (Sumirizer TPL-R made by Sumitomo Chemical Co., Ltd.) | 0.5 |
| Benzophenone type UV absorber | 0.5 |

-continued

| Composition of coating liquid |
|---|
| (Chinubin-1130 made by Ciba Geigy AG) |

EXAMPLE A8

| Composition of coating liquid | |
|---|---|
| Urethane emulsion (having a solid content of 40% and available in the name of Alone VE-1200) | 10 parts |
| Polyvinyl alcohol (in the form of a 10% aqueous solution) | 50 |
| Hindered amine type light stabilizer (Sumisorb-500 made by Sumitomo Chemical Co., Ltd.) | 0.5 |
| Phenolic antioxidant (Irganox 245 made by Ciba Geigy AG) | 0.5 |

EXAMPLE A9

| Composition of coating liquid | |
|---|---|
| Water-dispersed polyester resin (having a solid content of 15% and available in the name of Vynal) | 40 parts |
| Polyvinyl alcohol (in the form of a 10% aqueous solution) | 55 |
| Sensitizer (polystyrene oligomer with a melting point of 60° C. and a molecular weight of 860) | 10 |
| Sulfide type antioxidant (Sumirizer TPL-R made by Sumitomo Chemical Co., Ltd.) | 0.5 |
| Benzophenone type UV absorber (Chinubin-1130 made by Ciba Geigy AG) | 0.5 |
| Release agent (KM742 made by the Shin-Etsu Chemical Co., Ltd.) | 4 |

EXAMPLE A10

| Composition of coating liquid | |
|---|---|
| Urethane emulsion (having a solid content of 40% and available in the name of Alone VE-1200) | 10 parts |
| Polyvinyl alcohol (in the form of a 10% aqueous solution) | 50 |
| Sensitizer (aminobenzophenone) | 7 |
| Hindered amine type light stabilizer (Sumisorb-500 made by Sumitomo Chemical Co., Ltd.) | 0.5 |
| Phenolic antioxidant (Irganox 245 made by Ciba Geigy AG) | 0.5 |
| Release agent (amino-modified silicone KF-383 made by the Shin-Etsu Chemical Co., Ltd.) | 1 |
| Release agent (epoxy-modified silicone X-22-343 made by the Shin-Etsu Chemical Co., Ltd.) | 1 |

EXAMPLE A11

| Composition of coating liquid | |
|---|---|
| Urethane emulsion (having a solid content of 40% and available in the name of Alone VE-1200) | 10 parts |
| Polyvinyl alcohol (in the form of a 10% aqueous solution) | 50 |
| Sensitizer (polystyrene oligomer with a melting point of 60° C. and a molecular | 10 |

-continued

| Composition of coating liquid |
|---|
| weight of 860) |

EXAMPLE A12

| Composition of coating liquid | |
|---|---|
| Water-dispersed polyester resin (having a solid content of 15% and available in the name of Vynal) | 40 parts |
| Polyvinyl alcohol (in the form of a 10% aqueous solution) | 55 |
| Sensitizer (aminobenzophenone) | 7 |

EXAMPLE A13

| Composition of coating liquid | |
|---|---|
| Water-dispersed polyester resin (having a solid content of 15% and available in the name of Vynal) | 40 parts |
| Polyvinyl alcohol (in the form of a 10% aqueous solution) | 55 |
| Sensitizer (polystyrene oligomer with a melting point of 60° C. and a molecular weight of 860) | 20 |

EXAMPLE A14

| Composition of coating liquid | |
|---|---|
| Water-dispersed polyester resin (having a solid content of 15% and available in the name of Vynal) | 40 parts |
| Polyvinyl alcohol (in the form of a 10% aqueous solution) | 55 |
| Sensitizer (polystyrene oligomer with a melting point of 60° C. and a molecular weight of 860) | 1 |

EXAMPLE A15

| Composition of coating liquid | |
|---|---|
| Water-dispersed polyester resin (having a solid content of 15% and available in the name of Vynal) | 40 parts |
| Polyvinyl alcohol (in the form of a 10% aqueous solution) | 55 |
| Sensitizer (polystyrene oligomer with a melting point of 60° C. and a molecular weight of 860) | 5 |

EXAMPLE A16

| Composition of coating liquid | |
|---|---|
| Urethane emulsion (having a solid content of 40% and available in the name of Alone VE-1200) | 10 parts |
| Polyvinyl alcohol (in the form of a 10% aqueous solution) | 50 |
| Phenolic antioxidant (Irganox 245 made by Ciba Geigy AG) | 1 |
| Benzophenone type UV absorber (Chinubin-1130 made by Ciba Geigy AG) | 1 |

EXAMPLE A17

| Composition of coating liquid | |
|---|---|
| Urethane emulsion (having a solid content of 40% and available in the name of Alone VE-1200) | 10 parts |
| Polyvinyl alcohol (in the form of a 10% aqueous solution) | 50 |
| Phenolic antioxidant (Irganox 245 made by Ciba Geigy AG) | 2 |
| Benzophenone type UV absorber (Chinubin-1130 made by Ciba Geigy AG) | 2 |

EXAMPLE A18

| Composition of coating liquid | |
|---|---|
| Urethane emulsion (having a solid content of 40% and available in the name of Alone VE-1200) | 10 parts |
| Polyvinyl alcohol (in the form of a 10% aqueous solution) | 50 |
| Phenolic antioxidant (Irganox 245 made by Ciba Geigy AG) | 4 |
| Benzophenone type UV absorber (Chinubin-1130 made by Ciba Geigy AG) | 4 |

EXAMPLE A19

| | |
|---|---|
| Urethane emulsion (having a solid content of 40% and available in the name of Alone VE-1200) | 2 parts |
| Polyvinyl alcohol (in the form of a 10% aqueous solution) | 90 |
| Sensitizer (urethane oligomer) | 8 |

EXAMPLE A20

| | |
|---|---|
| Urethane emulsion (having a solid content of 40% and available in the name of Alone VE-1200) | 5 parts |
| Polyvinyl alcohol (in the form of a 10% aqueous solution) | 70 |
| Sensitizer (urethane oligomer) | 8 |

EXAMPLE A21

| | |
|---|---|
| Urethane emulsion (having a solid content of 40% and available in the name of Alone VE-1200) | 10 parts |
| Polyvinyl alcohol (in the form of a 10% aqueous solution) | 50 |
| Sensitizer (urethane oligomer) | 8 |

EXAMPLE A22

| | |
|---|---|
| Urethane emulsion (having a solid content of 40% and available in the name of Alone VE-1200) | 15 parts |
| Polyvinyl alcohol (in the form of a 10% aqueous solution) | 30 |
| Sensitizer (urethane oligomer) | 8 |

EXAMPLE A23

| | |
|---|---|
| Urethane emulsion (having a solid content of 40% and available in the name of Alone VE-1200) | 20 parts |
| Polyvinyl alcohol (in the form of a 10% aqueous solution) | 20 |
| Sensitizer (urethane oligomer) | 8 |

EXAMPLE A24

| | |
|---|---|
| Water-dispersed polyester resin (having a solid content of 15% and available in the name of Vynal) | 40 parts |
| Polyvinyl alcohol (in the form of a 10% aqueous solution) | 55 |

COMPARATIVE EXAMPLE A1

The procedure of Ex. A1 was followed with the exception that only the water-dispersed polyester was used as a coating liquid, thereby obtaining a heat transfer image-receiving sheet for the purpose of comparison.

COMPARATIVE EXAMPLE A2

The procedure of Ex. A1 was followed with the exception that the following composition was used as a coating liquid, thereby obtaining a heat transfer image-receiving sheet for the purpose of comparison.

| Composition of coating liquid | |
|---|---|
| Water-dispersed polyester resin Vynal (having a solid content of 15%) | 100 parts |
| Antioxidant Sumirizer TPL-R | 0.5 |
| UV absorber Chinubin-1130 | 0.5 |

COMPARATIVE EXAMPLE A3

The procedure of Ex. A1 was followed with the exception that a 10% aqueous solution of polyvinyl alcohol was used as a coating liquid, thereby obtaining a heat transfer image-receiving sheet for the purpose of comparison.

COMPARATIVE EXAMPLE A4

The procedure of Ex. A1 was followed with the exception that an urethane emulsion Alone VE-1200 (having a solid content of 40%) was used as a coating liquid, thereby obtaining a heat transfer image-receiving sheet for the purpose of comparison.

COMPARATIVE EXAMPLE A5

The procedure of Ex. A1 was followed with the exception that the following composition was used as a coating liquid, thereby obtaining a heat transfer image-receiving sheet for the purpose of comparison.

| Composition of coating liquid | |
|---|---|
| Water-dispersed polyester resin Vynal (having a solid content of 15%) | 40 parts |
| Sensitizer (pol···tyrene oligomer with a melting point of 60° C. and a molecular weight of 860) | 10 |

COMPARATIVE EXAMPLE A6

The procedure of Ex. A1 was followed with the exception that the following composition was used as a coating liquid, thereby obtaining a heat transfer image-receiving sheet for the purpose of comparison.

| Composition of coating liquid | |
|---|---|
| Polyvinyl alcohol (in the form of a 10% aqueous solution) | 60 parts |
| Sensitizer (aminobenzophenone) | 3 |

COMPARATIVE EXAMPLE A7

The procedure of Ex. A1 was followed with the exception that the following composition was used as a coating liquid, thereby obtaining a heat transfer image-receiving sheet for the purpose of comparison.

| Composition of coating liquid | |
|---|---|
| Polyvinyl alcohol (in the form of a 10% aqueous solution) | 60 parts |
| Phenolic antioxidant (Irganox 245 made by Ciba Geigy AG) | 3 |
| Benzophenone type UV absorber (Chinubin-1130 made by Ciba Geigy AG) | 3 |

Apart from the foregoing, prepared was the following ink composition for forming a dye carrier layer, which was then coated on the surface of a 6-μm thick polyethylene terephthalate film subjected on its back surface to heat-resistant treatment to a dry coverage of 1.0 g/m$^2$ by means of a wire bar coater Subsequent drying gave a heat transfer sheet.

| Ink composition | |
|---|---|
| C.I. Disperse Blue 24 | 1.0 part |
| Polyvinyl butyral resin | 10.0 |
| Methyl ethyl ketone/toluene (at a weight ratio of 1:1) | 90.0 |

Each of the heat transfer image-receiving sheets according to this invention and for the purpose of comparison was overlaid on the above-mentioned heat transfer sheet, while the dye carrier layer of the latter was located in opposition to the dye-receiving layer of the former. With a thermal head, recording was then made from the back side of the heat transfer sheet at a head application voltage of 11.0 V, a pulse width of 10 msec. and a dot density of 6 dots/line. The results are reported in Table 1. The data set out in Table 1 were obtained in the following manners.

(1) Sensitivity

The density - 1 - of light reflected off the image of Comp. Ex. A2 as measured (with Macbeth Densitometer RD-914), was used for relative estimation

(2) Light resistance

A sample was subjected to an 8-hour light resistance testing according to JIS L 0842. How much the sample faded from the initial density was then determined.

(3) Blocking

The imagewise surface of one image-receiving sheet was left overlaid on the back surface of another image-receiving sheet at 60° C. under a load of 20 g/m$^2$ for 24 hours, followed by a peel test. The resistance to blocking of the sample was determined in terms of the degree of adhesion between both the sheets.

5: Both the sheets did not adhere to each other at all.
4: Both the sheets adhered locally to each other.
3: Peeling was accomplished with a crunching sound with the imagewise surface becoming rough.
2: Peeling was attended by difficulties, generating a crumping sound.
1: Both the sheets adhered so firmly to each other that they could not be peeled off.

(4) Blurring

After the image had been allowed to stand at 60° C. for 200 hours, the dots were observed with the naked eye and a loupe.

5: The dots were not blurred or left intact.
4: The dots were slightly blurred.
3: The dots were blurred.
2: There was a slight blur on the boundary between the printed and unprinted regions.
1: There was a serious blur on the boundary between the printed and unprinted regions.

It is noted that 1 and 2 are the results of observation with the naked eye, while 3-5 are the results of observation with a loupe.

TABLE 1

| | Sensitivity | Light Resistance | Blocking | Blurring |
|---|---|---|---|---|
| Example A1 | 1.5 | 2.0% | 5 | 4 |
| Example A2 | 1.8 | 3.5 | 4 | 4 |
| Example A3 | 1.9 | 2.7 | 4 | 4 |
| Example A4 | 1.4 | 3.2 | 5 | 4 |
| Example B5 | 1.7 | 2.2 | 4 | 4 |
| Example A6 | 1.8 | 2.5 | 4 | 4 |
| Example A7 | 1.1 | 2.4 | 5 | 4 |
| Example A8 | 1 | 2.9 | 4 | 4 |
| Example A9 | 1.4 | 2.1 | 5 | 4 |
| Example A10 | 1.7 | 3.3 | 4 | 4 |
| Example A11 | 1.4 | 5.8 | 5 | 4 |
| Example A12 | 1.6 | 4.7 | 5 | 4 |
| Example A13 | 1.9 | 5.6 | 2 | 2 |
| Example A14 | 0.7 | 6.3 | 5 | 5 |
| Example A15 | 1.1 | 5.5 | 5 | 4 |
| Example A16 | 1.2 | 2.3 | 4 | 4 |
| Example A17 | 1.3 | 1.9 | 4 | 4 |
| Example A18 | 1.6 | 1.9 | 1 | 2 |
| Example A19 | 0.8 | 2.2 | 2 | 2 |
| Example A20 | 0.8 | 2.4 | 3 | 2 |
| Example A21 | 1.3 | 4 | 4 | 4 |
| Example A22 | 1.5 | 4.2 | 4 | 4 |
| Example A23 | 1.6 | 4.4 | 4 | 4 |
| Example A24 | 0.6 | 4.4 | 5 | 5 |
| Comp. Ex. A1 | 0.9 | 7.9 | 5 | 5 |
| Comp. Ex. A2 | 1 | 2.1 | 4 | 4 |
| Comp. Ex. A3 | 0.3 | 1 | 5 | 5 |
| Comp. Ex. A4 | 0.95 | 5.0 | 5 | 5 |
| Comp. Ex. A5 | 0.6 | 4.4 | 5 | 5 |
| Comp. Ex. A6 | 1.7 | 6.9 | 4 | 4 |
| Comp. Ex. A7 | 0.7 | 2.4 | 3 | 3 |
| Comp. Ex. A8 | 0.7 | 1.9 | 4 | 4 |

EXAMPLE B1

With a wire bar coater, synthetic paper (of 110 μm in thickness and made by Oji Yuka K.K.) as a substrate sheet was coated on one surface with a coating liquid composed of the following components to a dry coverage of 5.0 g/m$^2$. Subsequent drying gave a heat transfer image-receiving sheet according to this invention.

| Composition of coating liquid | |
|---|---|
| Phenolic resin (Standright HP-708N made by Hitachi Kasei K.K.) | 15 parts |
| Lauric acid amide | 5 |
| Epoxy-modified silicone (X-22-343 made by the Shin-Etsu Chemical Co., Ltd.) | 10 |
| Amino-modified silicone (KF-393 made by the Shin-Etsu Chemical Co., Ltd.) | 10 |
| Methylene chloride | 85 |

EXAMPLE B2

The procedure of Ex. B1 was followed with the exception that the following composition was used as a coating liquid, thereby obtaining a heat transfer image-receiving sheet for the purpose of comparison.

| | |
|---|---|
| Polyester resin (Vylon 560 made by Toyobo Co., Ltd.) | 100 parts |
| Polyisocyanate (Colonate 2030 made by Nippon Polyurethane K.K.) | 5 |
| Glycerin lauric acid amide | 10 |
| Epoxy-modified silicone (X-22-343 made by the Shin-Etsu Chemical Co., Ltd.) | 10 |
| Amino-modified silicone (KF-393 made by the Shin-Etsu Chemical Co., Ltd.) | 10 |
| Toluene | 400 |

EXAMPLE B3

The procedure of Ex. B1 was followed with the exception that the following composition was used as a coating liquid, thereby obtaining a heat transfer image-receiving sheet according to this invention.

| | |
|---|---|
| Heat-curable acrylic resin (Nucler 410 made by Mitsui Du Pont Chemical Co., Ltd.) | 100 parts |
| Polyethylene glycol monostearate | 10 |
| Epoxy-modified silicone (X-22-343 made by the Shin-Etsu Chemical Co., Ltd.) | 10 |
| Amino-modified silicone (KF-393 made by the Shin-Etsu Chemical Co., Ltd.) | 10 |
| Methyl ethyl ketone | 400 |

EXAMPLE B4

The procedure of Ex. B1 was followed with the exception that the following composition was used as a coating liquid, thereby obtaining a heat transfer image-receiving sheet according to this invention.

| | |
|---|---|
| Heat-curable acrylic resin (Nucler 410 made by Mitsui Du Pont Chemical Co., Ltd.) | 100 parts |
| Glycerin monostearate | 10 |
| Epoxy-modified silicone (X-22-343 made by the Shin-Etsu Chemical Co., Ltd.) | 10 |
| Amino-modified silicone (KF-393 made by the Shin-Etsu Chemical Co., Ltd.) | 10 |
| Methyl ethyl ketone | 400 |

EXAMPLE B5

The procedure of Ex. B1 was followed with the exception that the following composition was used as a coating liquid, thereby obtaining a heat transfer image-receiving sheet according to this invention.

| | |
|---|---|
| Polyester resin (Vylon 56 made by Toyobo Co., Ltd.) | 100 parts |
| Polyisocyanate (Colonate 2030 made by Nippon Polyurethane K.K.) | 5 |
| Diglycidyl stearate | 10 |
| Epoxy-modified silicone (X-22-343 made by the Shin-Etsu Chemical Co., Ltd.) | 10 |
| Amino-modified silicone (KF-393 made by the Shin-Etsu Chemical Co., Ltd.) | 10 |
| Methyl ethyl ketone | 400 |

EXAMPLE B6

The procedure of Ex. B1 was followed with the exception that the following composition was used as a receiving sheet according to this invention.

| | |
|---|---|
| Polyester resin (Vylon 560 made by Toyobo Co., Ltd.) | 40 parts |
| Vinyl chloride/vinyl acetate copolymer (#1000A made by Denki Kagaku Kogyo K.K.) | 60 |
| Dioctyl phthalate | 20 |
| Acrylic silicon resin (GS-30 made by Toa Gosei Kagaku K.K.) | 15 |
| Polyisocyanate (Colonate 2030 made by Nippon Polyurethane K.K.) | 5 |
| Toluene/methyl ethyl ketone | 400 |

EXAMPLE B7

| | |
|---|---|
| Polyester resin (Vylon 560 made by Toyobo Co., Ltd.) | 100 parts |
| Polyisocyanate (Colonate 2030 made by Nippon Polyurethane K.K.) | 10 |
| Diglycidyl stearate | 10 |
| Epoxy-modified silicone (X-22-343 made by the Shin-Etsu Chemical Co., Ltd.) | 10 |
| Amino-modified silicone (KF-393 made by the Shin-Etsu Chemical Co., Ltd.) | 10 |

EXAMPLE B8

| | |
|---|---|
| Polyester resin (Vylon 56 made by Toyobo Co., Ltd.) | 100 parts |
| Polyisocyanate (Barknock 750 made by Sumitomo Chemical Co., Ltd.) | 5 |
| Diglycidyl stearate | 10 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B9

| | |
|---|---|
| Polyester resin (Vylon 560 made by | 100 parts |

-continued

| | |
|---|---|
| Toyobo Co., Ltd.) | |
| Polyisocyanate (Barknock 750 made by Sumitomo Chemical Co., Ltd.) | 10 |
| Diglycidyl stearate | 10 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B10

| | |
|---|---|
| Polyester resin (Vylon 560 made by Toyobo Co., Ltd.) | 100 parts |
| Polyisocyanate (Barknock 750 made by Sumitomo Chemical Co., Ltd.) | 15 |
| Diglycidyl stearate | 10 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B11

| | |
|---|---|
| Polyester resin (Vylon 560 made by Toyobo Co., Ltd.) | 100 parts |
| Polyisocyanate (Colonate 2030 made by Nippon Polyurethane K.K.) | 2 |
| Diglycidyl stearate | 10 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B12

| | |
|---|---|
| Polyester resin (Vylon 560 made by Toyobo Co., Ltd.) | 100 parts |
| Polyisocyanate (Barknock 750 made by Sumitomo Chemical Co., Ltd.) | 2 |
| Diglycidyl stearate | 10 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B13

| | |
|---|---|
| Polyester resin (Vylon 560 made by Toyobo Co., Ltd.) | 100 parts |
| Polyisocyanate (Barknock 750 made by Sumitomo Chemical Co., Ltd.) | 5 |
| Diglycidyl stearate | 20 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B14

| | |
|---|---|
| Polyester resin (Vylon 560 made by Toyobo Co., Ltd.) | 100 parts |
| Polyisocyanate (Barknock 750 made by Sumitomo Chemical Co., Ltd.) | 5 |
| Diglycidyl stearate | 30 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B15

| | |
|---|---|
| Polyester resin (Vylon 560 made by Toyobo Co., Ltd.) | 100 parts |
| Polyisocyanate (Barknock 750 made by Sumitomo Chemical Co., Ltd.) | 5 |
| Diglycidyl stearate | 40 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B16

| | |
|---|---|
| Phenolic resin (Standright HP-708N made by Hitachi Kasei K.K.) | 15 parts |
| Lauric acid amide | 3 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B17

| | |
|---|---|
| Phenolic resin (Standright HP-708N made by Hitachi Kasei K.K.) | 15 parts |
| Lauric acid amide | 1 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B18

| | |
|---|---|
| Phenolic resin (Standright HP-708N made by Hitachi Kasei K.K.) | 15 parts |
| Lauric acid amide | 10 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

EXAMPLE B19

| | |
|---|---|
| Polyester resin (Vylon 560 made by | 100 parts |

-continued

| | |
|---|---|
| Toyobo Co., Ltd.) | |
| Polyisocyanate (Barknock 750 made by Sumitomo Chemical Co., Ltd.) | 25 |
| Diglycidyl stearate | 10 |
| Amino-modified silicone (KF-393 made by the Shin-Etsu Chemical Co., Ltd.) | 10 |
| Epoxy-modified silicone (X-22-343 made by the Shin-Etsu Chemical Co., Ltd.) | 10 |

COMPARATIVE EXAMPLE B1

The procedure of Ex. B1 was followed with the exception that the following composition was used as a coating liquid, thereby obtaining a heat transfer image-receiving sheet for the purpose of comparison.

| | |
|---|---|
| Phenolic resin (Standright HP-708N made by Hitachi Kasei K.K.) | 15 parts |
| Epoxy-modified silicone (X-22-343 made by the Shin-Etsu Chemical Co., Ltd.) | 10 |
| Amino-modified silicone (KF-393 made by the Shin-Etsu Chemical Co., Ltd.) | 10 |
| Methylene chloride | 85 |

COMPARATIVE EXAMPLE B2

The procedure of Ex. B1 was followed with the exception that the following composition was used as a coating liquid, thereby obtaining a heat transfer image-receiving sheet for the purpose of comparison.

| | |
|---|---|
| Polyester resin (Vylon 560 made by Toyobo Co., Ltd ) | 100 parts |
| Polyisocyanate (Colonate 2030 made by Nippon Polyurethane Co., Ltd ) | 5 |
| Epoxy-modified silicone (X-22-343 made by the Shin-Etsu Chemical Co., Ltd.) | 10 |
| Amino-modified silicone (KF-393 made by the Shin-Etsu Chemical Co., Ltd.) | 10 |
| Toluene | 400 |

COMPARATIVE EXAMPLE B3

The procedure of Ex. B1 was followed with the exception that the following composition was used as a coating liquid, thereby obtaining a heat transfer image-receiving sheet for the purpose of comparison.

| | |
|---|---|
| Heat-curable acrylic resin (Nucler 410 made by Mitsui Du Pont Chemical Co., Ltd.) | 100 parts |
| Epoxy-modified silicone (X-22-343 made by the Shin-Etsu Chemical Co., Ltd.) | 10 |
| Amino-modified silicone (KF-393 made by the Shin-Etsu Chemical Co., Ltd.) | 10 |
| Methyl ethyl ketone | 400 |

COMPARATIVE EXAMPLE B4

The procedure of Ex. B1 was followed with the exception that the following composition was used as a coating liquid, thereby obtaining a heat transfer image-receiving sheet for the purpose of comparison.

| | |
|---|---|
| Polyester resin (Vylon 560 made by Toyobo Co., Ltd.) | 40 parts |
| Vinyl chloride/vinyl acetate copolymer (#1000A made by Denki Kagaku Kogyo K.K.) | 60 |
| Dioctyl phthalate | 20 |
| Acrylic silicon resin (GS-30 made by Toa Gosei Kagaku K.K.) | 15 |
| Toluene/methyl ethyl ketone | 400 |

Apart from the foregoing, prepared was the following ink composition for forming a dye carrier layer, which was then coated on the surface of a 6-μm thick polyethylene terephthalate film subjected on its back surface to heat-resistant treatment to a dry coverage of 1.0 g/m$^2$ by means of a wire bar coater. Subsequent drying gave a heat transfer sheet.

| Ink composition | |
|---|---|
| C.I. Disperse Blue 24 | 1.0 part |
| Polyvinyl butyral resin | 10.0 |
| Methyl ethyl ketone/toluene (at a weight ratio of 1:1) | 90.0 |

Each of the heat transfer image-receiving sheets according to this invention and for the purpose of comparison was overlaid on the above-mentioned heat transfer sheet, while the dye carrier layer of the latter was located in opposition to the dye-receiving layer of the former. With a thermal head, recording was then made from the back side of the heat transfer sheet at a head application voltage of 11.0 V, a pulse width of 10 msec. and a dot density of 6 dots/line. The results are reported in Table 2. The data set out in Table 2 were obtained in the following manners.

(1) Printing sensitivity (O.D.)

The density of reflection of each image was measured with Macbeth Densitometer RD-914.

(2) Storability

The image-receiving sheets on which images were formed under the foregoing printing conditions were allowed to stand at 60° C. for 200 hours. Then, the degree of scattering of the dots were visually estimated.

TABLE 2

| | Sensitivity | Blurring | Storability |
|---|---|---|---|
| Example B1 | 1.32 | 4 | excellent |
| Example B2 | 1.41 | 4 | " |
| Example B3 | 1.71 | 4 | " |
| Example B4 | 1.68 | 4 | " |
| Example B5 | 1.39 | 4 | " |
| Example B6 | 1.45 | 4 | " |
| Example B7 | 1.19 | 4 | " |
| Example B8 | 1.47 | 4 | " |
| Example B9 | 1.44 | 4 | " |
| Example B10 | 1.39 | 4 | " |
| Example B11 | 1.41 | 3 | " |
| Example B12 | 1.49 | 4 | " |
| Example B13 | 1.57 | 4 | " |
| Example B14 | 1.65 | 4 | " |
| Example B15 | 1.42 | 3 | " |
| Example B16 | 1.09 | 4 | " |
| Example B17 | 0.76 | 5 | " |
| Example B18 | 1.52 | 3 | " |
| Example B19 | 0.74 | 4 | " |
| Comp. Ex. B1 | 0.62 | 4 | excellent |

TABLE 2-continued

| | Sensitivity | Blurring | Storability |
|---|---|---|---|
| Comp. Ex. B2 | 0.75 | 4 | " |
| Comp. Ex. B3 | 0.57 | 4 | " |
| Comp. Ex. B4 | 1.50 | 4 | bad |

Extimation of blurring
1: The printing was found to be blurred by observation with the naked eye.
2: The printing was found to be slightly blurred by observation with the naked eye.
3: The dots were found to be blurred by observation under a loupe.
4: The dots were found to be slightly blurred by observation under a loupe.
5: The dots were found to be not blurred by observation under a loupe.

What is claimed is:

1. A heat transfer image-receiving sheet comprising a substrate sheet and a dye-receiving layer formed on at least one surface of said substrate sheet, said dye-receiving layer comprising at least two microscopically separated phase regions of resins differing in dyeability, said phase regions comprising (i) a dispersion phase of a lipophilic resin having improved dyeability and (ii) a dispersion medium phase of a hydrophilic resin, wherein lipophilic additives for improving color development and light resistance are incorporated substantially in said dispersion phase alone.

2. A heat transfer image-receiving sheet as claimed in claim 1, wherein said additives comprise at least one additive selected from the group consisting of sensitizers, thermal release agents, antioxidants, UV absorbers and light stabilizers.

3. A heat transfer image-receiving sheet as claimed in claim 1, wherein the lipophilic resin forming said dispersion phase comprises a water-dispersible resin and said hydrophilic resin forming said dispersion medium phase comprises a water-soluble resin.

4. A heat transfer image-receiving sheet as claimed in claim 3, wherein a mixing ratio of said water-dispersible resin to said water-soluble resin is in the range of 0.5–5.0.

5. A heat transfer image-receiving sheet as claimed in claim 3, wherein said water-dispersible resin comprises at least one material selected from the group consisting of acrylic resin, urethane resin, acrylic urethane resin, polyester resin, vinyl acetate resin, vinyl chloride/vinyl acetate resin, vinyl chloride rein and nylon.

* * * * *